US006910474B1

(12) United States Patent
Scherer

(10) Patent No.: US 6,910,474 B1
(45) Date of Patent: Jun. 28, 2005

(54) BLOCK SPLITTING ASSEMBLY AND METHOD

(75) Inventor: Ronald James Scherer, Oak Park Heights, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 09/691,864

(22) Filed: Oct. 19, 2000

Related U.S. Application Data

(63) Continuation-in-part of application No. 09/330,879, filed on Jun. 11, 1999, now Pat. No. 6,321,740.

(51) Int. Cl.[7] ..... B24D 1/32
(52) U.S. Cl. ..... 125/23.01; 125/40; 125/24
(58) Field of Search ..... 125/23.01, 24, 125/40, 42, 30.01

(56) References Cited

U.S. PATENT DOCUMENTS

| | | | | |
|---|---|---|---|---|
| 806,951 | A | | 12/1905 | Bryning |
| 2,775,236 | A | | 12/1956 | Blum |
| 3,095,868 | A | * | 7/1963 | Mangis |
| 3,120,842 | A | | 2/1964 | Cox et al. |
| 3,559,631 | A | | 2/1971 | Mangis |
| 3,809,049 | A | | 5/1974 | Fletcher et al. |
| 4,335,549 | A | | 6/1982 | Dean, Jr. |
| 4,848,309 | A | | 7/1989 | Alderete |
| 5,017,049 | A | | 5/1991 | Sievert |
| 5,066,070 | A | | 11/1991 | Clarke |
| 5,152,275 | A | | 10/1992 | Landhuis |
| 5,413,086 | A | | 5/1995 | Trudeau |
| 5,662,094 | A | | 9/1997 | Giacomelli |
| 5,722,386 | A | | 3/1998 | Fladgard et al. |
| 5,827,015 | A | | 10/1998 | Woolford et al. |
| 6,050,255 | A | | 4/2000 | Sievert |
| 6,102,026 | A | * | 8/2000 | Fladgard et al. ..... 125/23.01 |
| 6,149,352 | A | | 11/2000 | MacDonald |
| 6,321,740 | B1 | * | 11/2001 | Scherer et al. ..... 125/23.01 |

FOREIGN PATENT DOCUMENTS

| | | |
|---|---|---|
| DE | 1950950 | 6/1970 |
| EP | 0 294 267 A1 | 12/1988 |
| EP | 0294267 | 12/1988 |
| GB | 1509747 | 5/1978 |
| GB | 2258184 | 7/1991 |
| JP | 09038922 | 2/1997 |
| WO | WO 00/47825 | 8/2000 |

OTHER PUBLICATIONS

U.S. Appl. No. 09/884,795; filed Jun. 19, 2001; Block Splitting Assembly and Method.

* cited by examiner

*Primary Examiner*—Eileen P. Morgan
(74) *Attorney, Agent, or Firm*—Merchant & Gould P.C.

(57) ABSTRACT

A block splitting assembly and method which uses any of a variety of projections to supplement or replace the action of the splitting blade in splitting and dressing concrete or masonry block. A gripper assembly holds the block during splitting.

18 Claims, 12 Drawing Sheets

BLOCK SPLITTING ASSEMBLY AND METHOD

This application is a continuation-in-part of application Ser. No. 09/330,879 filed on Jun. 11, 1999, now U.S. Pat. No. 6,321,740.

FIELD OF INVENTION

The invention relates generally to manufacture of masonry block. More specifically, it relates to equipment and processes for the creation of decorative faces on masonry block. Even more specifically, the invention relates to equipment and processes for producing roughened textures and the appearance of weathered or rock-like edges on masonry block.

BACKGROUND OF THE INVENTION

The process of splitting a masonry block to create a rock-like appearance on the exposed face of the block is known. See, for example, Besser, U.S. Pat. No. 1,534,353, which discloses the manual splitting of blocks using a hammer and chisel. Automated equipment to split block is well-known, and generally includes a splitting table comprising a supporting table and one or more hydraulically-actuated splitting blades. These machines are useful for the high-speed processing of blocks. They produce a rock-face finish on the blocks. The edges of the faces are generally well-defined, i.e., "sharp".

It is sometimes desirable to produce a concrete product that has edges which appear to be weathered. This has been a desired look for concrete pavingstones for sometime. Recently, it has become desirable to create the weathered look on the decorative face of concrete retaining wall blocks. The common process for producing the weathered look on pavers is to "tumble" the pavers in a rotary drum to knock off their sharp edges. This process can be used with some retaining wall blocks, as well, provided that the blocks do not have any features, such as integral concrete locator flanges, that would be damaged by the tumbling process. Tumbling is not an option with such blocks. The problem with the tumbling process is that it is costly. The process requires the capital investment in a tumbling apparatus, and the upkeep of that equipment. In addition, the pavers or blocks must be removed from the production line, tumbled, and then reassembled into suitable cubes for transportation. This makes the process labor-intensive.

Another option is to use a hammermill to attack the face of the block with various hammers. This option can slow down production, if it is done "in line", because the process can only move as fast as the hammermill can operate on each block, and the block may need to be manipulated-flipped over and or rotated-to attack all of its edges.

Accordingly, there is a need for equipment and a process that will create the appearance of weathered edges on retaining wall blocks, in such a manner that it will not slow down the production line, will not add costly equipment to the line, will not be labor-intensive, and will not have high cull rates when processing blocks with integral locator flanges or other similar features.

SUMMARY OF THE INVENTION

In accordance with a first aspect of the invention, there is provided a block splitter assembly comprising first and second opposed splitting blade assemblies, each of the first and second splitting blade assemblies comprising respective first and second splitting blades and one or more projections positioned adjacent to each of the first and second blades.

In accordance with a second aspect of the invention, there is provided a block splitter comprising first and second opposed splitting blade assemblies, each of the first and second opposed splitting blade assemblies comprising a plurality of projections.

In accordance with another aspect of the invention, there is provided a masonry block splitter comprising first and second opposed splitting blade assemblies, the first blade assembly comprising a first splitting blade having first and second sides, said first blade assembly comprising a plurality of projections adjacent the first splitting blade first side and a plurality of projections adjacent the first splitting blade second side, the second blade assembly comprising a second splitting blade having first and second sides, the second blade assembly comprising a plurality of projections adjacent the second splitting blade first side and a plurality of projections adjacent the second splitting blade second side.

In accordance with a further aspect of the invention, there is provided a method of splitting masonry block using a masonry block splitter, comprising first and second opposed splitting blade assemblies, said first blade assembly comprising a first splitting blade having first and second sides, said first blade assembly comprising a plurality of projections adjacent said first splitting blade first side and a plurality of projections adjacent said first splitting blade second side, said second blade assembly comprising a second splitting blade having first and second sides, said second blade assembly comprising a plurality of projections adjacent said second splitting blade first side and a plurality of projections adjacent said second splitting blade second side, said method comprising the step of striking the masonry block with said first and second opposed splitting blade assemblies.

In another aspect of the invention, a gripper assembly is employed to hold the work piece together from the sides during splitting. The gripper assembly could optionally include side knives or projections.

DETAILED DESCRIPTION OF THE PREFERRED EMBODIMENTS

Figure 1:
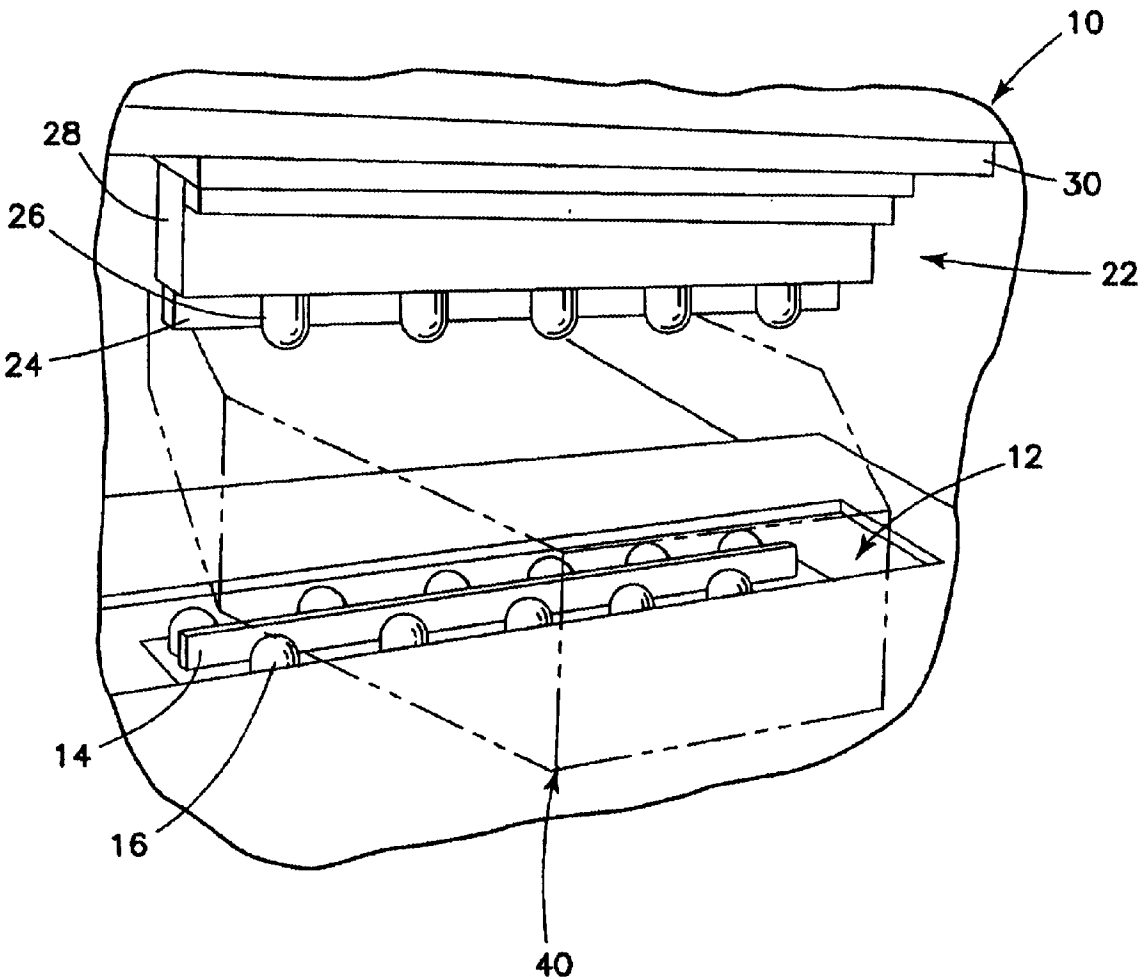
FIG. 1 is a partial perspective view of a block splitting machine using the block splitter blade assembly of the invention.

Attention is now directed to the figures where like parts are identified with like numerals through several views. In FIG. 1, a conventional block splitting machine modified in accordance with invention is depicted, in part, showing in particular the block splitter assembly 10. Generally, block splitting machines may be obtained from Lithibar Co., located in Holland, Mich. In particular, the Lithibar Co. 6386 was used in practicing the invention. The block splitter assembly generally has opposed first 12 and second 22 splitting blade assemblies. The first splitting blade assembly 12 is positioned at the bottom of the block splitter 10 and, as depicted, includes a splitting blade 14 and a number of projections 16 positioned on either side of and adjacent to the blade.

The invention may be used with any variety of blocks molded or formed through any variety of processes including those blocks and processes disclosed in U.S. Pat. No. 5,827,015 issued Oct. 27, 1998, U.S. Pat. No. 5,017,049 issued May 21, 1991 and U.S. Pat. No. 5,709,062 issued Jan. 20, 1998.

An upper or second splitting blade assembly 22 may also be seen in FIG. 1. The second splitting blade assembly 22 also includes a splitting blade 24 and a plurality of projections 26 located on either side of the blade 24. The second splitting blade assembly may be attached to the machine's top plate 30 through a blade holder 28. The position of the work piece 40, (shown in phantom), within the block splitter may be seen in FIG. 1, in the ready-to-split position.

Figure 2B:
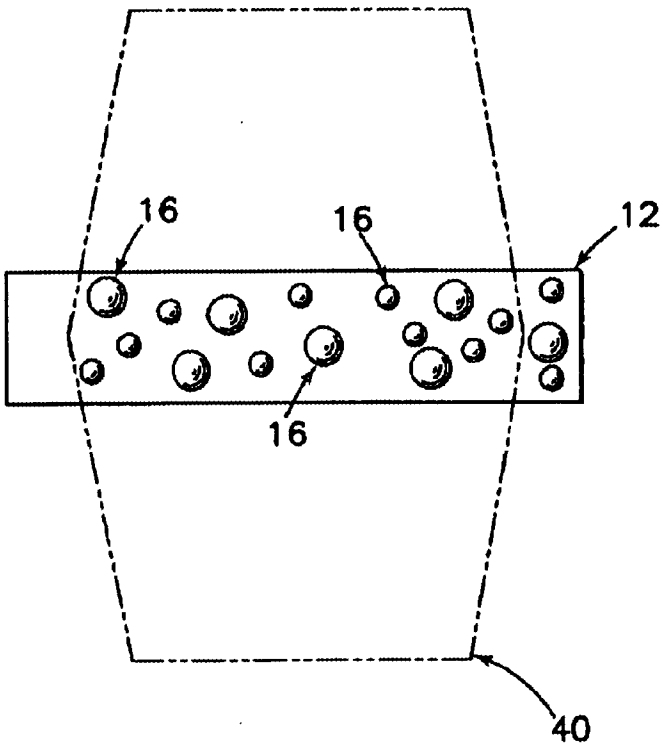
FIG. 2B is a top plan view of one portion of a splitting blade assembly also showing projections of various diameters positioned in a random manner.
Figure 2A:
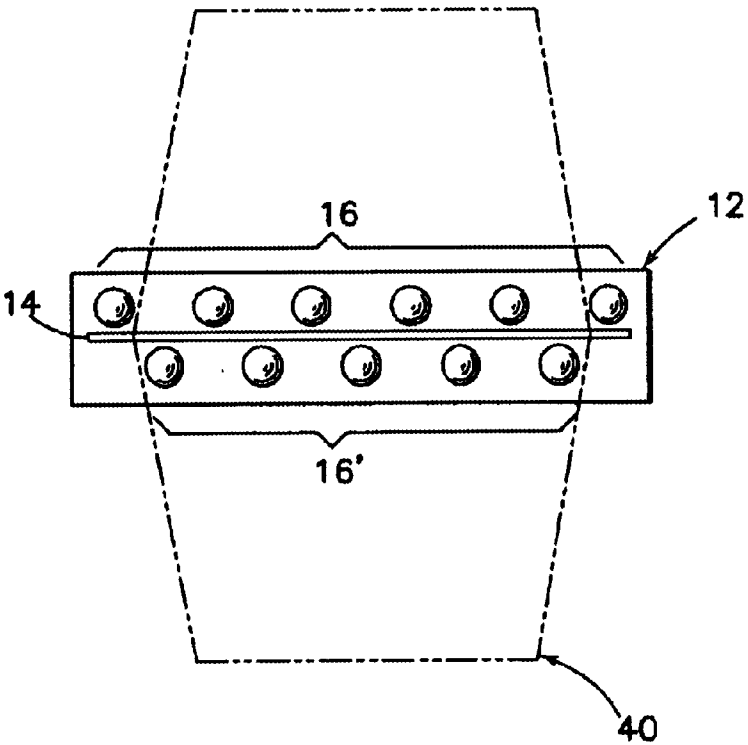
FIG. 2A is a top plan view of one portion of a splitting blade assembly in accordance with the invention.

As can be seen in FIG. 2A, the splitting blade assembly 12 is generally comprised of a number of projections 16 positioned adjacent to blade 14 and on either side of the blade 14. As shown, the projections 16 on the first side of the blade are staggered in relationship to the projections 16' on the second side of the blade. The projections on either side of the blade may also be aligned depending upon the intent of the operator.

As can be seen in FIG. 2B, the projections 16 may be used without a splitting blade. The projections 16 may also be varied in diameter or perimeter, (if not round), and placed randomly on the splitting assembly 12. Any number of ordered or random patterns of projections 16 may be created using regular or irregular spacing depending on the effect to be created in the split block.

Figure 2C:
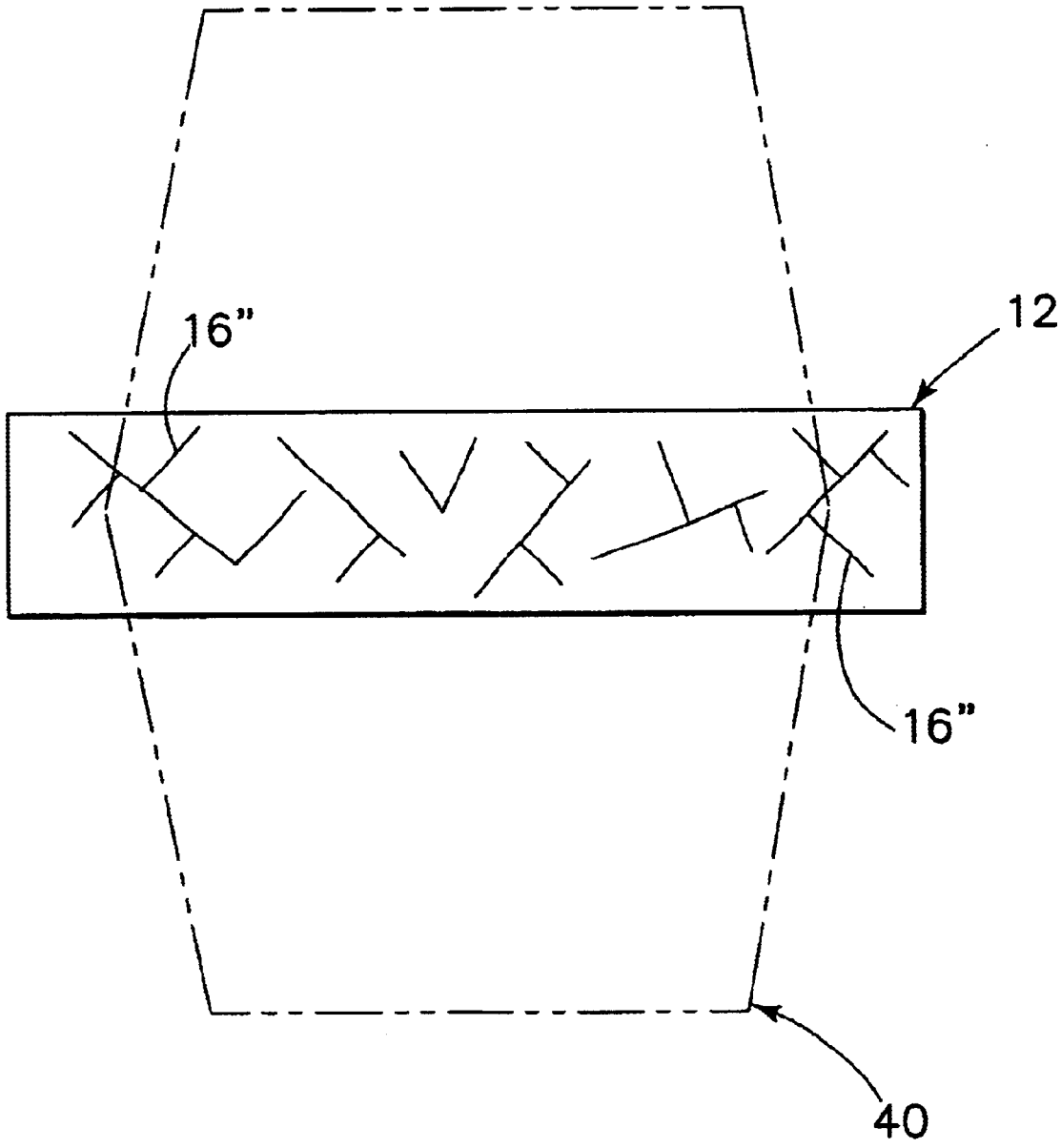
FIG. 2C is a top plan view of one portion of a splitting blade assembly in accordance with a further alternative embodiment of the invention comprising projections which are random connected and unconnected panels.

FIG. 2C shows a further alternative embodiment of the invention where plates 16" are attached to either, or both, assemblies 12 and 22. As can be seen, these plates may be configured in random order and left unconnected across the surface of the assembly 12. The invention has been practiced using steel plates about four inches long welded to the assembly to provide a number of partially connected projections 16" about two inches high. As shown in FIGS. 1, 2A, and 2B, the projections 16 and 16' may have a rounded shape. However, the shape of the projections may also be pyramidal, cubic, or pointed with one or more points on the top surface of the projection. In FIGS. 2B and 2C, the relative position of the work piece 40 is again shown in phantom outline.

Generally, the projections may have a diameter of about ½ to 1 and ¼ inches and may be attached by welding, screwing or other suitable means. The height of the projections may be about 1 and ¼ inches and varied about ¾ of an inch shorter or taller depending upon the affect to be created in the block at splitting. Attaching the projections by threading or screwing, see FIGS. 8, 9 and 11, allows easy adjustment of projection height.

Figure 3:
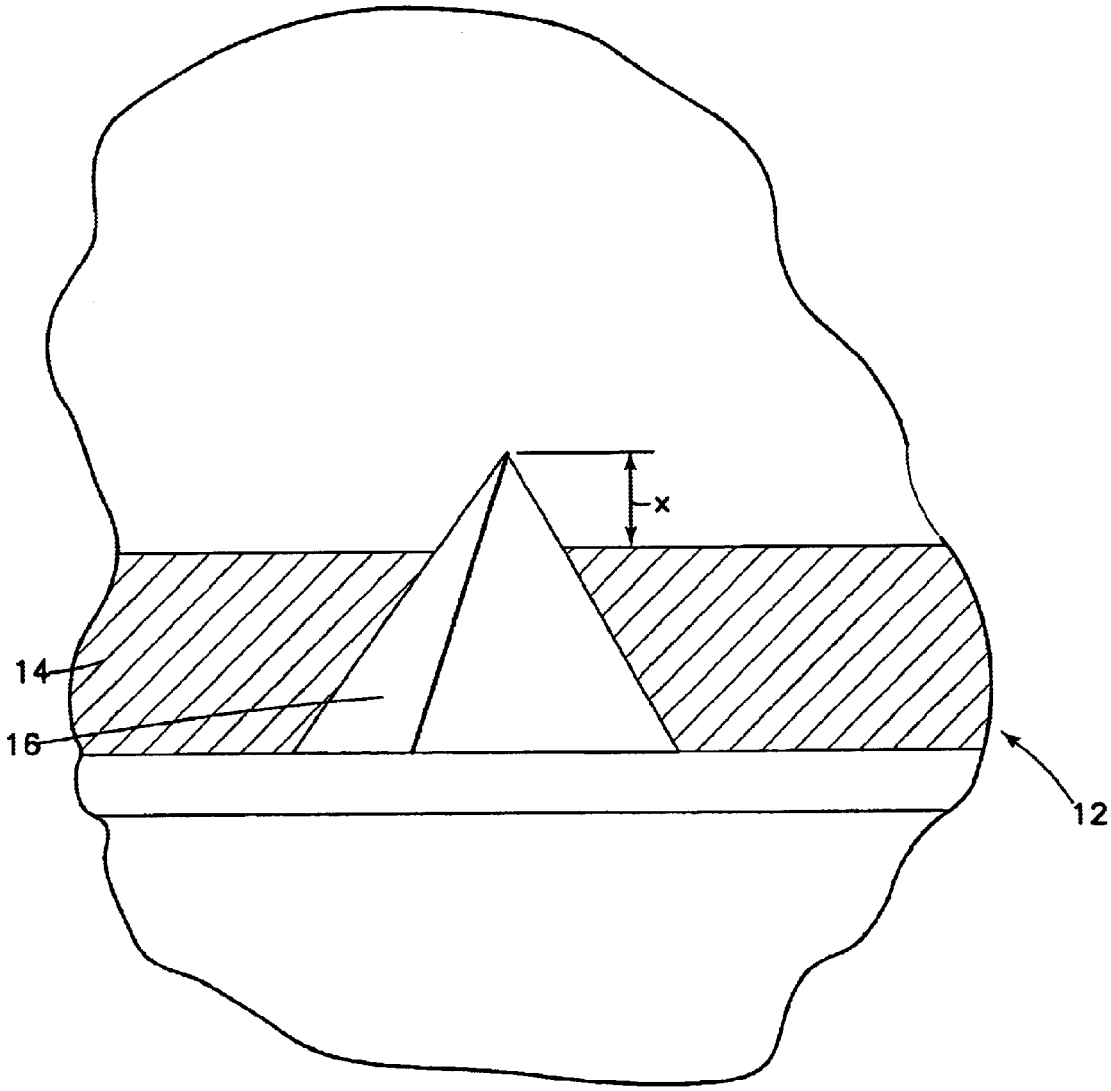
FIG. 3 is a side elevational view of an alternative embodiment of a projection in accordance with the invention.
Figure 4A:
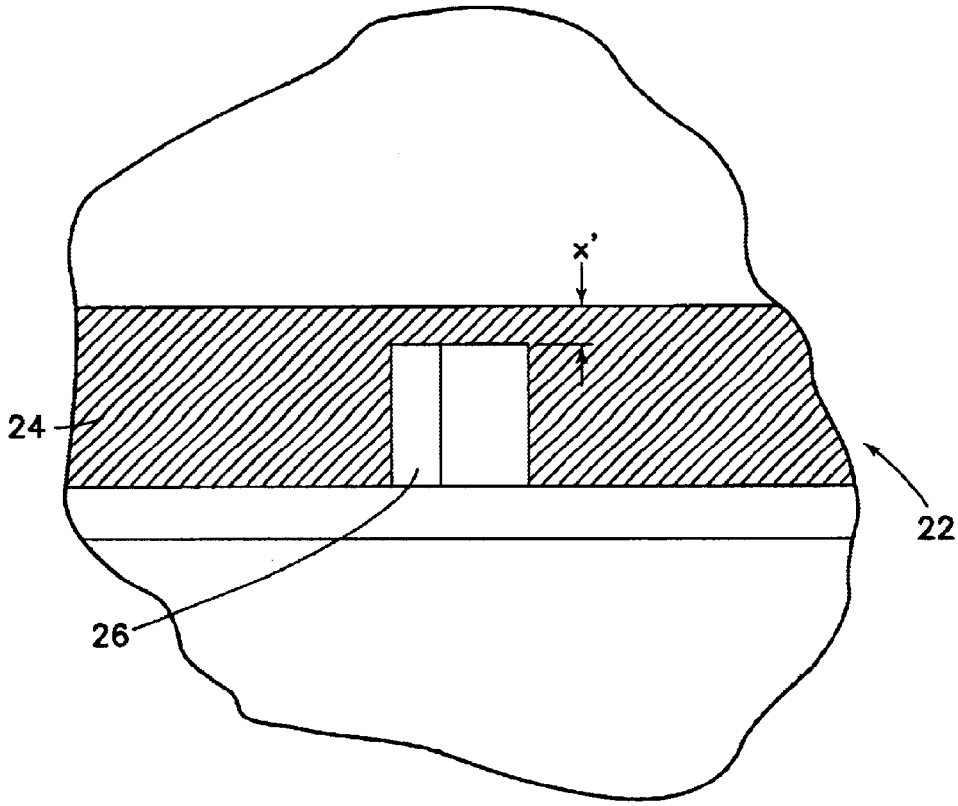
FIG. 4A is a side elevational view of a further alternative embodiment of a projection in accordance with the invention.
Figure 4B:
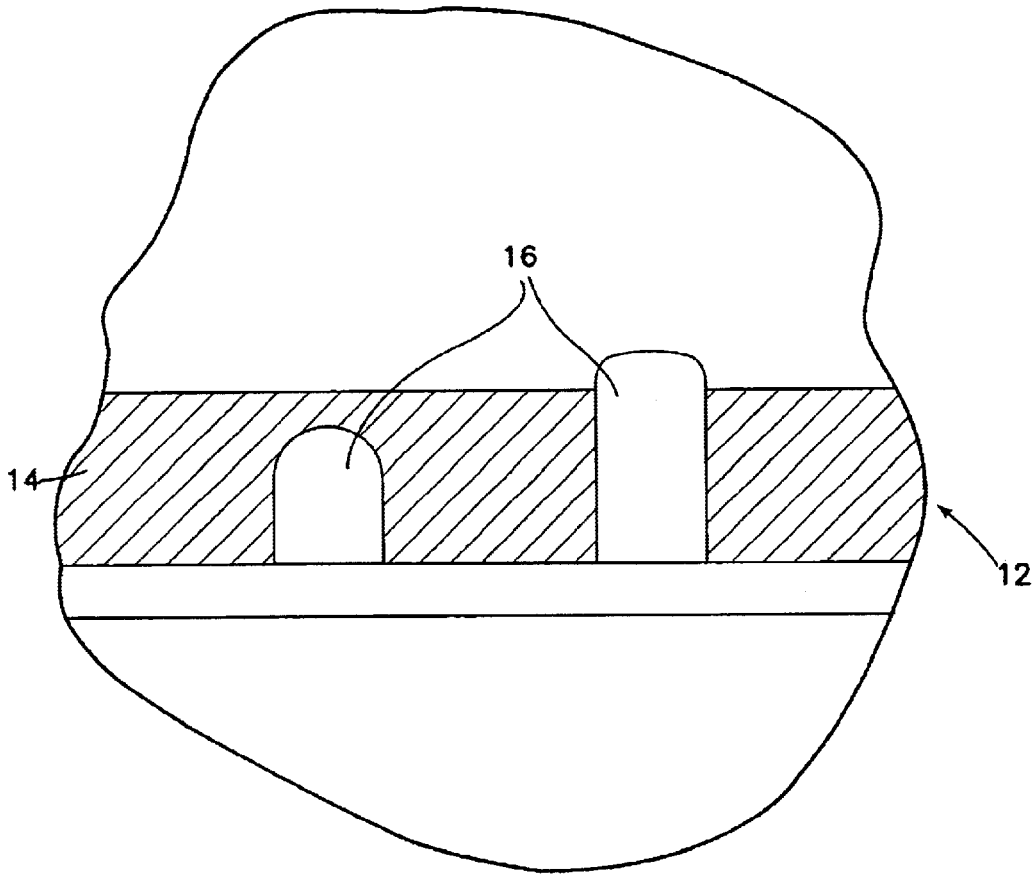
FIG. 4B is a side elevational view of another alternative embodiment of the invention depicting projections of varying height.

The relative height of the projection and blade may also be varied depending upon the effect that is to be created in the block split according to the invention. Specifically, as can be seen in FIG. 3, the relative height of the blade 14 may be less than the relative height of the projection 16. Alternatively, as can be seen in FIG. 4A the relative height of the blade may be greater than the height of the projections 26. For example, we have found with the first splitting blade assembly 12 that X may range from about ⅛ to about ⅜ of an inch beyond the first blade. With regard to the second splitting blade assembly 22, X' may range from about 1/16 to ⅛ of an inch beyond the height of the plurality of the projections.

Projections 16 such as those depicted in FIG. 2A have been found useful having a diameter of about 1 and ¼ inches and, when used with a blade 14, having a height of about ⅛ of an inch above the blade in the first or lower assembly and ⅛ of an inch below the blade in the second or upper assembly. Overall, the height of the projections may vary up or down about ⅜ of an inch relative to the height of the blade.

Figure 5:
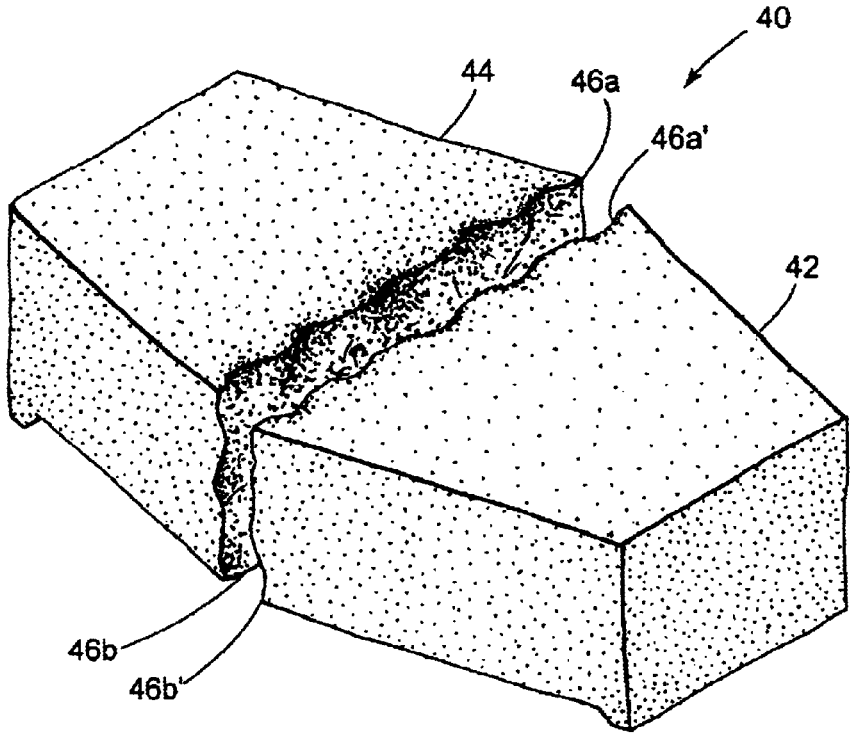
FIG. 5 is a perspective view of a split work piece (forming two masonry blocks), which was split using the splitter blade assembly of the invention.

In operation, the work piece is generally centered in the block splitter according to known practices as seen in FIGS. 1, 2A, 2B and 2C. The block splitter is then activated resulting in the first and second opposing splitting blade assemblies converging on, and striking, the work piece 40. In operation, the first and second splitting blade assemblies may travel anywhere from about ¼ to one inch into the top and bottom surfaces of the work piece. The work piece 40 is then split resulting in an uneven patterning on the split edges 46*a*, 46*b* and 46*a'*, 46*b'* of the resulting blocks, 44 and 42, as illustrated in FIG. 5. As depicted, the work piece 40' is split in two. However, it is possible and within the scope of the invention to split the work piece into more than two pieces.

The distance traveled by the projections 16 into the work piece may be varied by adjusting the limit switches on the machine and, in turn, varying the hydraulic pressure with which the splitting assembly acts. Generally, the splitting assemblies act on the block with a pressure ranging from about 600 to 1000 psi, and preferably about 750 to 800 psi.

As will be well understood by one of skill in the art, the splitting machine may include opposed hydraulically activated side knife assemblies (not shown) which impinge upon the block with the same timing and in the same manner as the opposed top and bottom assemblies. Projections 16 may also be used to supplement or replace the action of the side knives. For example, side knives similar to the upper splitting blade 24 shown in FIG. 8 can be employed.

Figure 6:
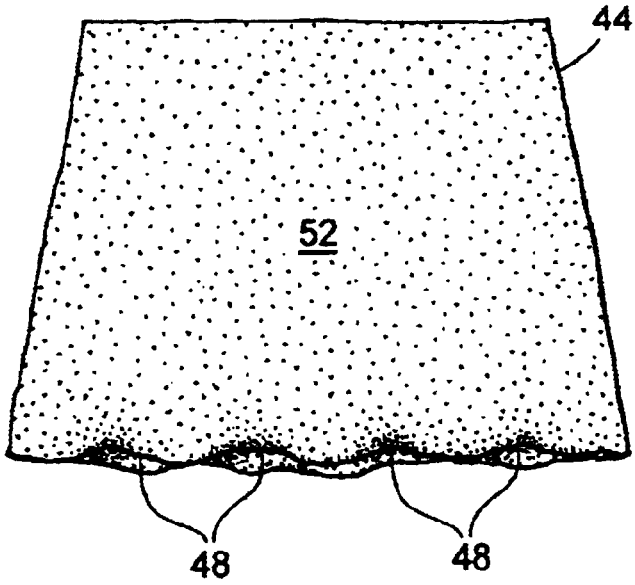
FIG. 6 is a top plan view of a masonry block split using the splitter blade assembly of the invention.
Figure 7:
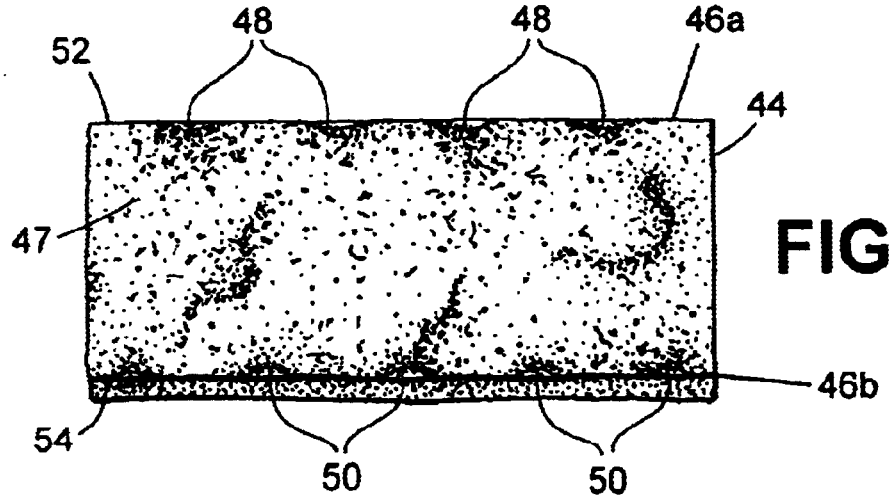
FIG. 7 is a front elevational view of the masonry block depicted in FIG. 6.

Closer examination of block 44 after splitting (see FIGS. 6 and 7) shows the formation of exaggerated points of erosion in the front, split surface 47 of the block 44. With the block 44 depicted, both the first and second blade assemblies 12 and 22 comprised projections 16 and 26, respectively. As a result, depressions 48 and 50 were formed at the upper and lower edges 46*a*, 46*b* of the front, split surface 47 of the block 44, at the intersection of the upper 52 and lower 54 respective surface of the block 44.

The magnitude of the indentations, 48 and 50, or points of erosion is far greater than that which is caused by conventional splitting blades and may be varied by varying the prominence of the projections 16 and 26, (height and size), relative to the height and thickness of the blade. In one embodiment of the invention, masonry block may be split with only a row or rows of projections 16 and 26 without a blade 14 and 24.

Figure 8:
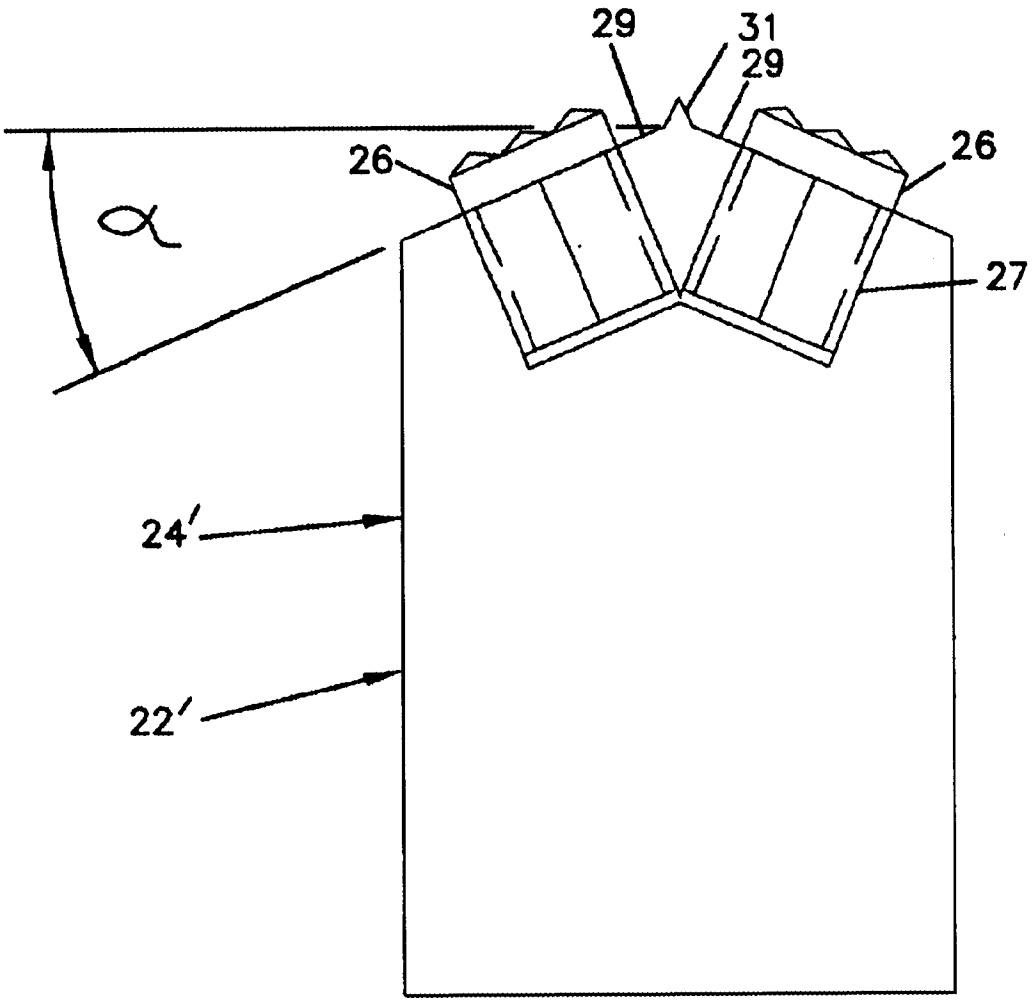
FIG. 8 is a partial sectional end view of an alternative embodiment of a top splitter blade assembly.
Figure 9:
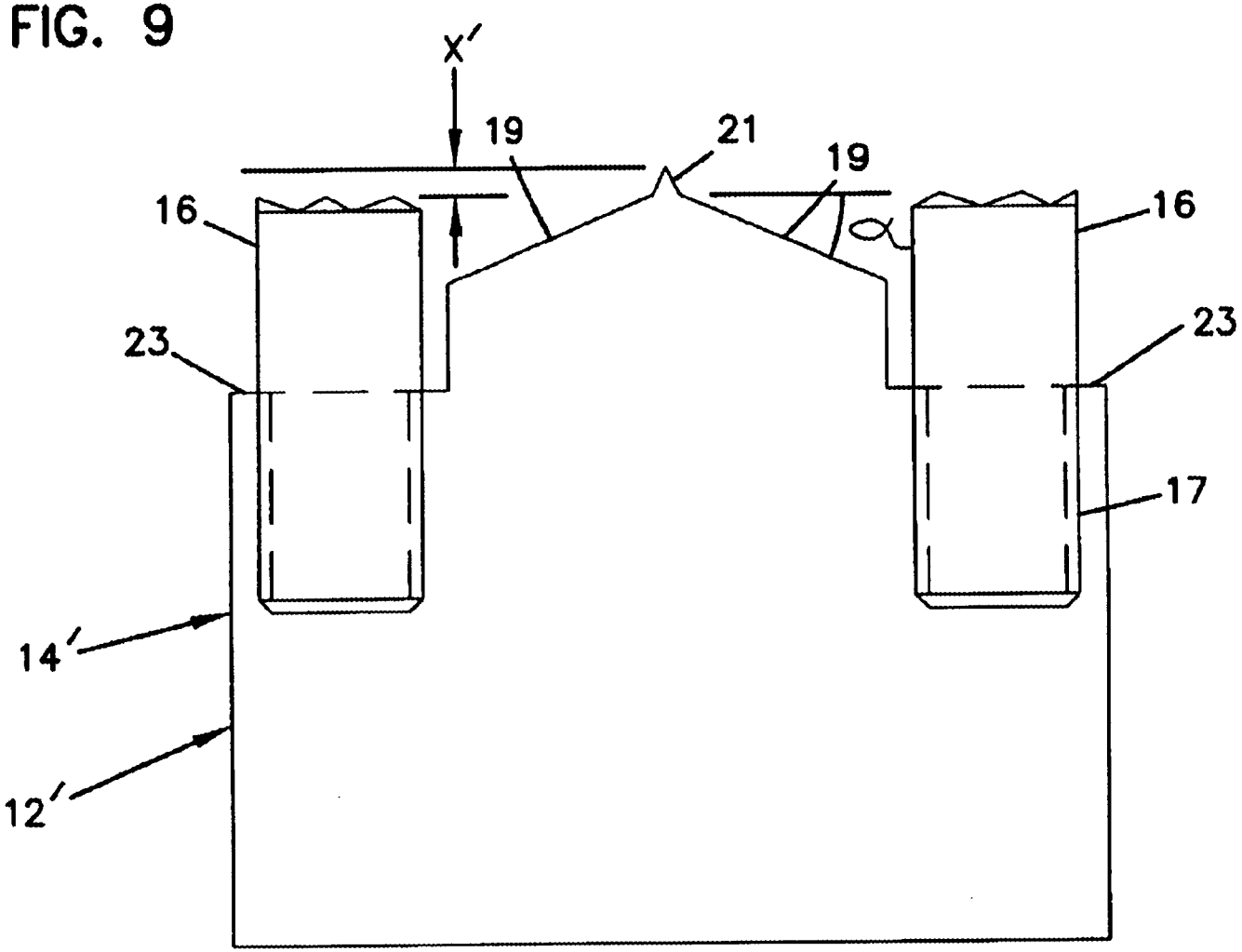
FIG. 9 is a partial sectional end view of an alternative embodiment of a bottom splitter blade assembly.

Referring to FIGS. 8 and 9, alternative embodiments of a top splitting blade assembly 22' and bottom splitting blade assembly 12', respectively, are shown. It has been found that more massive blades 14', 24' having projections 16, 26 thereon create a more desirable block face appearance. Blades 14', 24' each include a central cutting edge 21 and 31, respectively, and surfaces 19, 29 extending outwardly therefrom. Surfaces 19, 29 are at a blunt angle so as to make the top and bottom edges of the block face more rounded and therefore rock-like. The surfaces 19, 29 are preferably at an angle β between 0° and 30° relative to horizontal, most preferably 23°.

Blades 14', 24' include projections 16, 26 that are adjustable and removable. In this way, the same blade assembly can be used for splitting different block configurations by changing the number, location, spacing and height of the projections. Projections 16, 26 are preferably threaded into corresponding threaded openings 17, 27 for adjustment, although other height adjustment means could be employed. The top surface of projections 16, 26 is jagged, comprising many pyramids in a checkerboard pattern. Projections such as these can be obtained from Fairlane Products Co. It will be understood that a variety of other projection top surface configurations could be employed.

The height of the top surface of projections is preferably a distance X' below the top of cutting edge 21, 31, most preferably 0.040 inch below. As discussed above with respect to other embodiments, the projections may extend further below, or some distance above, the top of the blade, within the principles of the invention. The projections shown are ¾ inch diameter with a 10 thread/inch pitch, and are 1.50 inches long. Diameters between 0.50 and 1.0 inch are believed preferable. The loose block material from the splitting process entering the threads, in combination with the vertical force of the splitting strikes, are considered sufficient to lock the projections in place.

The preferred top blade assembly 22' is 2.5 inches wide. Projections 26 extend perpendicularly from blade surfaces 29 and therefore strike the working piece at an angle.

The preferred bottom blade assembly 12' is 4.0 inches wide. Projections 16 extend upwardly from shoulders 23 on opposite sides of blade surfaces 19. This configuration breaks away more material and creates a more rounded rock-like top edge (the work piece is typically inverted) of the split blocks. Blade assembly 12' could optionally include projections 16 on blade surfaces 19, as shown in FIG. 11.

In operation, the blade assemblies of FIGS. 8 and 9 are used together and in the same manner described above with respect to cutting depth and hydraulic pressures. It will be understood that the bottom blade assembly could be used on top, and the top blade assembly could be used on the bottom.

Figure 10:
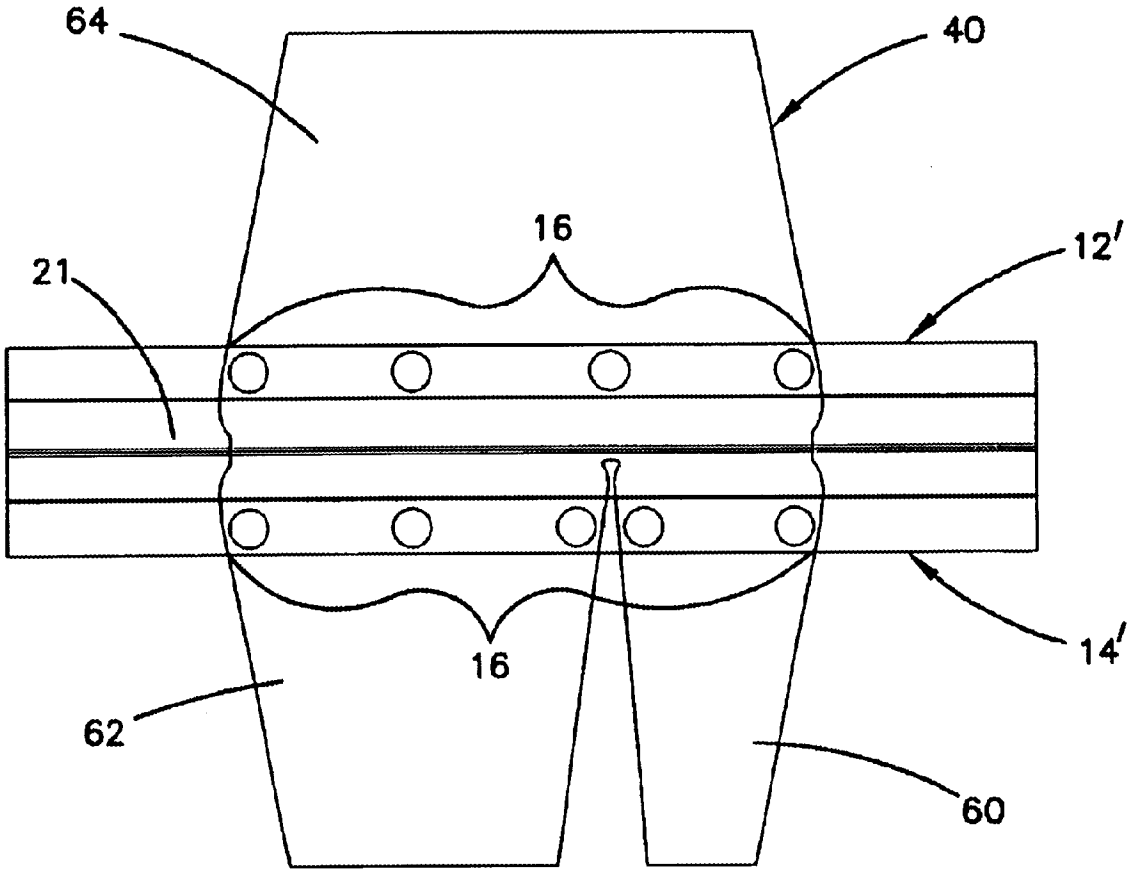
FIG. 10 is a top plan view of a portion of the FIG. 9 embodiment of a bottom splitter blade assembly shown in relation to a work piece.

Referring now to FIG. 10, a blade assembly 12' according to FIG. 9 is depicted positioned for striking a work piece 40. Work piece 40 comprises portions which will result in small 60, medium 62 and large 64 blocks. A projection 16 is preferably placed at each comer of the three blocks 60, 62, 64 to be created, as shown. In this way, more rounded, rock-like comers are formed in the splitting process. This positioning of projections at the block comers can be used in conjunction with mold configurations that pre-form the slab at the comers so as to better achieve this effect. Upper blade assembly 22' of FIG. 8 has similarly oriented projections except that they are closer to a centerline of the workpiece, as can be seen from FIG. 8.

Figure 11:
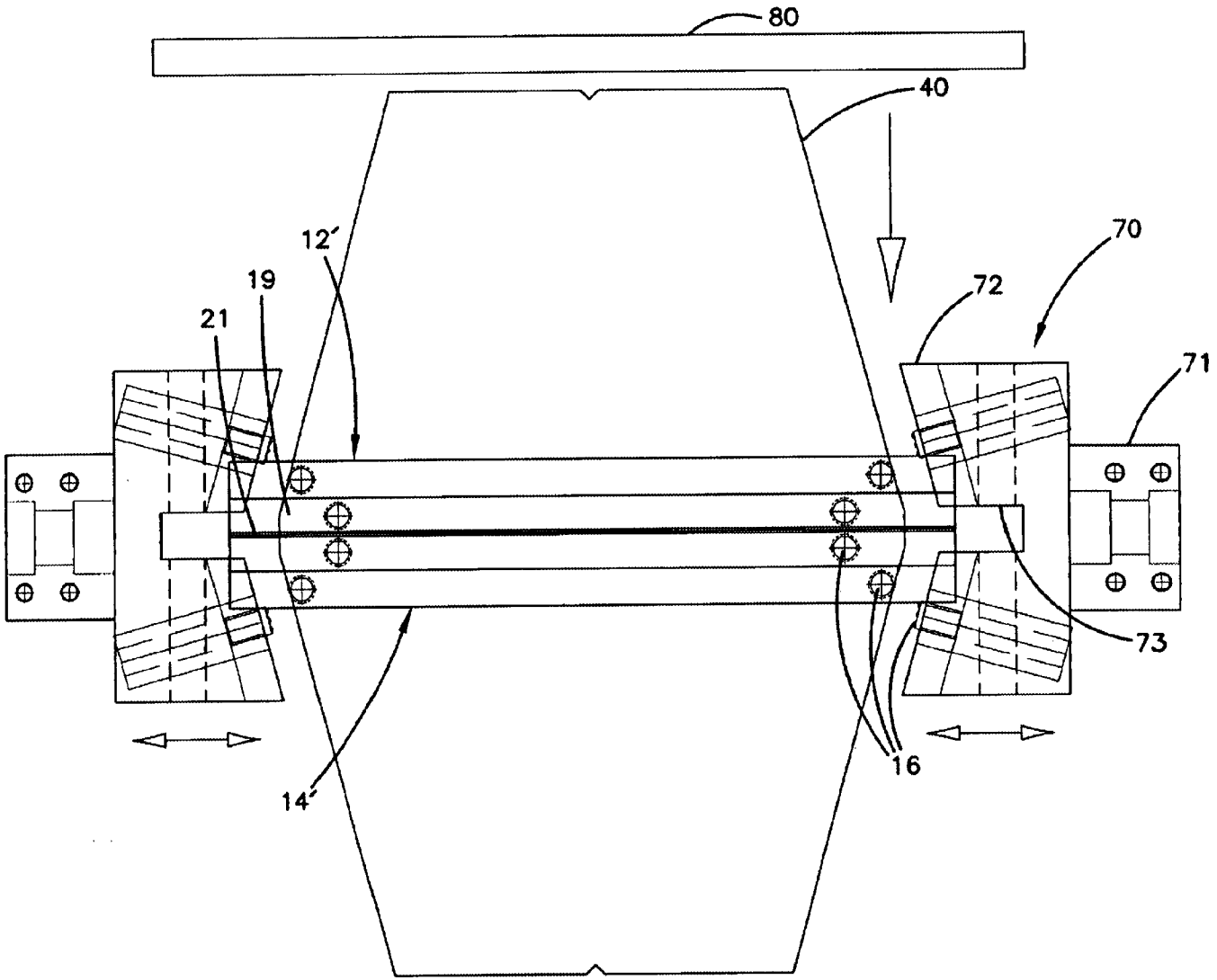
FIG. 11 is a top plan view of a gripper assembly according to the present invention, and another alternative embodiment of a bottom splitter blade assembly, shown in relation to a work piece.

Referring now to FIG. 11, a gripper assembly 70 is shown in conjunction with a work piece 40 and bottom splitting blade assembly 12'. Gripper assembly 70 is employed to assist with splitting certain types of larger block units. It is mounted via mounting head 71 on the existing side-knife cylinders of the splitting machine. Rubber shoes 72 are configured to conform to the corresponding outer surface of work piece 40. Each gripper assembly 70 moves in and out laterally, as indicated by arrows, in order to grip work piece 40 from both sides. In the preferred design, assembly 70 is 3.0 inches high and rubber shoes 72 are 50–100 Durometer hardness. The pressure applied by the hydraulic cylinders is the same as that for the upper and lower blades.

One benefit of this gripper assembly is improving the formation of rounded edges of a work piece made by a bottom blade. Work piece 40 is moved along the manufacturing line by positioning bar 80 in the direction of the arrow shown. During splitting, while the rear portion of work piece 40 is held in place by bar 80, the forward portion is free to move forwardly. Many splitting machines have a splitting action whereby the bottom blade moves to engage the product after the top blade has touched the top of the product. The initial cutting action of the top blade can begin to move the forward portion forwardly before the bottom blade has an opportunity to fully form a rounded edge on the forward block with, for example, projections 16 and/or blade surfaces 19. The bottom blade assembly can also lift the work piece, which is undesirable for a number of reasons. By holding the work piece 40 together during splitting, these problems are prevented.

Gripper assembly 70 can optionally include projections 16, as shown in FIG. 11. Projections 16 are preferably positioned slightly inside the top and bottom edges of the work piece (four projections for each gripper assembly 70) so when they strike the side of the work piece 40, more rounded block corners will be formed. The assembly can also include a side knife contained within its central cavity 73, having a blunt blade such as those described hereinabove, for forming rounded, rock-like side edges of the split blocks. It may be necessary to include an appropriate strength spring behind the side knife in order to get the desired action from the gripper and knife.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A block splitter for splitting a concrete workpiece in a splitting operation to produce a concrete block having at least one irregular split edge and surface, comprising:

a) an activatible first splitting blade assembly comprising a first splitting edge configured to split the workpiece to produce at least one block;

b) at least one first engagement surface extending outwardly from the first splitting edge at an acute angle relative to horizontal; and c) a first plurality of projections projecting from the first engagement surface adjacent the first splitting edge, said first plurality of projections being positioned to engage the workpiece and break away portions of the workpiece during the splitting operation.

2. The block splitter of claim 1, comprising a first engagement surface extending outwardly from the first splitting edge on each side thereof at acute angles relative to horizontal, and a plurality of said projections projecting from each of said first engagement surfaces adjacent the first splitting edge.

3. The block splitter of claim 2, including a second activatible splitting blade assembly opposed to the first splitting blade assembly, wherein the second splitting blade assembly includes a second splitting edge, a plurality of second engagement surfaces extending outwardly from the second splitting edge on opposite sides thereof at acute angles relative to horizontal, and a second plurality of projections projecting from the second engagement surfaces adjacent the second splitting edge, said second plurality of projections being positioned to engage the workpiece and break away portions of the workpiece during the splitting operation.

4. The block splitter of claim 3, wherein the acute angles of the engagement surfaces are between about 0 degrees and about 30 degrees.

5. The block splitter of claim 1, wherein the first splitting blade assembly is adapted to be activated by one or more hydraulically actuated cylinders.

6. The block splitter of claim 1, wherein the effective range of travel of the splitting blade assembly is variable.

7. The block splitter of claim 3, wherein the workpiece includes generally horizontal top and bottom surfaces and opposed, generally vertical, first and second side surfaces, wherein the first splitter assembly is adapted to engage the top surface of the workpiece, wherein the second splitter assembly is adapted to engage the bottom surface of the workpiece, and further including a third activatible splitter assembly adapted to engage the first side surface of the workpiece, and an opposed fourth activatible splitter assembly adapted to engage the second side surface of the workpiece, wherein each of the third and fourth splitter assemblies includes one or more projections positioned to engage the workpiece during the splitting operation.

8. The block splitter of claim 1, wherein the projections are generally cylindrical.

9. The block splitter of claim 8, wherein the projections have a diameter of between about 0.5 inch and about 1.25 inch.

10. The block splitter of claim 7, wherein each projection on one side of the splitting edge is aligned with a projection on the other side of the splitting edge.

11. A splitting blade assembly for splitting a concrete workpiece in a block splitter, comprising:

a) a splitting blade positioned to split the concrete workpiece when the workpiece is positioned in the block splitter, the splitting blade including a splitting edge; and b) a plurality of projections positioned adjacent to the splitting edge on at least one side thereof, the plurality of projections being spaced from the splitting edge and from each other and being positioned to engage the workpiece and break away portions of the workpiece during operation of the splitting blade to split the workpiece.

12. The splitting blade assembly of claim 11, comprising a plurality of projections positioned on each side of the splitting edge.

13. The splitting blade assembly of claim 11, wherein the projections are generally cylindrical.

14. The splitting blade assembly of claim 13, wherein the projections have a diameter of between about 0.5 inch and about 1.25 inch.

15. The splitting blade assembly of claim 11, wherein the projections are generally pyramidal in shape.

16. The splitting blade assembly of claim 12, wherein each projection on one side of the splitting edge is aligned with a projection on the other side of the splitting edge.

17. The splitting blade assembly of claim 12, wherein the projections on one side of the splitting edge are staggered with respect to the projections on the other side of the splitting edge.

18. The splitting blade assembly of claim 11, wherein the plurality of projections are adjacent the splitting blade along the length of the splitting blade.

* * * * *

UNITED STATES PATENT AND TRADEMARK OFFICE

CERTIFICATE OF CORRECTION

PATENT NO. : 6,910,474 B1
DATED : June 28, 2005
INVENTOR(S) : Scherer et al.

It is certified that error appears in the above-identified patent and that said Letters Patent is hereby corrected as shown below:

Title page,
Item [75], Inventor, add -- David Matthew LaCroix, Circle Pines, MN (US); --.

Column 4,
Line 2, after "high." start a new paragraph.

Column 6,
Lines 7, 8 and 10, delete "comers" insert -- corners --.

Signed and Sealed this

Twenty-eighth Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,910,474 B1
APPLICATION NO. : 09/691864
DATED : June 28, 2005
INVENTOR(S) : Scherer et al.

It is certified that error appears in the above-identified patent and that said Letters Patent is hereby corrected as shown below:

Col. 5, line 26: "angle β between" should read --angle α between--

Signed and Sealed this

Twenty-sixth Day of February, 2008

JON W. DUDAS
*Director of the United States Patent and Trademark Office*